US006905104B1

(12) United States Patent
Offenhauer et al.

(10) Patent No.: US 6,905,104 B1
(45) Date of Patent: Jun. 14, 2005

(54) PATIENT OR VISITOR SIGN-IN DEVICE

(76) Inventors: Keith Offenhauer, 629 17th Ave. West, Bradenton, FL (US) 34205; Harold Zimmerman, 1270 Glen Ave., Morristown, NJ (US) 08057

( * ) Notice: Subject to any disclaimer, the term of this patent is extended or adjusted under 35 U.S.C. 154(b) by 0 days.

(21) Appl. No.: 10/793,256

(22) Filed: Mar. 3, 2004

(51) Int. Cl.[7] ..... A47B 97/04
(52) U.S. Cl. ..... 248/452; 248/444.1
(58) Field of Search ..... 248/452, 444.1, 248/447, 458, 457, 455, 252, 267; 40/661.03, 106.1

(56) References Cited

U.S. PATENT DOCUMENTS

| | | | | | |
|---|---|---|---|---|---|
| 456,089 | A | * | 7/1891 | Harrison | 248/452 |
| 2,203,383 | A | * | 6/1940 | Davis | 134/110 |
| 3,031,795 | A | * | 5/1962 | Frost | 248/452 |
| 3,082,568 | A | * | 3/1963 | Horvath | 248/458 |
| 3,896,576 | A | * | 7/1975 | Wolf et al. | 40/367 |
| 4,586,730 | A | | 5/1986 | Shulyak | |
| 4,610,324 | A | | 9/1986 | Mexicotte | |
| 5,052,650 | A | * | 10/1991 | Beile et al. | 248/451 |
| D324,399 | S | | 3/1992 | Murphy | |
| 5,116,012 | A | | 5/1992 | Offenhauer et al. | |
| 5,145,141 | A | | 9/1992 | Hunter | |
| 5,308,034 | A | | 5/1994 | Hunter | |
| D353,275 | S | | 12/1994 | Longhurst | |
| 5,413,382 | A | | 5/1995 | Cornell et al. | |
| 5,523,880 | A | * | 6/1996 | Pidgeon et al. | 359/450 |
| 5,607,223 | A | * | 3/1997 | Brotz | 362/99 |
| 5,897,934 | A | * | 4/1999 | Yeh | 281/45 |
| 6,386,589 | B1 | | 5/2002 | Yuh | |

* cited by examiner

*Primary Examiner*—Ramon O. Ramirez
*Assistant Examiner*—Amy J. Sterling
(74) *Attorney, Agent, or Firm*—Charles J. Prescott

(57) ABSTRACT

A sign-in device having a privacy screen provides a clipboard which supports a sign-in sheet for patent or visitor sign-in purposes. An elongated spool of substantially opaque flexible sheet material is held within a housing or support of the paper clamp. An elongated header bar is movably attached to a side margin of the board. An exposed end margin of the opaque material is attached to the header bar whereby movement of the header bar along the length of the clipboard causes the opaque material to be withdrawn from the spool forming the privacy screen which covers and conceals a selected portion of the sign-in sheet which includes the names and/or signatures of previously signed-in patients or visitors.

11 Claims, 6 Drawing Sheets

PATIENT OR VISITOR SIGN-IN DEVICE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to paper clipboard structures and more particularly to a sign-in sheet and support clipboard therefor which is privacy-compliant with the Health Information Patient Privacy Act (HIPPA).

2. Description of Related Art

The use of clipboards which have a generally flat writing surface for supporting a separate sheet of writing material which is clamped in place by a clamp attached at one end of the clipboard are well known. In addition, a number of prior art patented devices are known to applicant which disclose unique clipboard structure for various purposes.

For example, in U.S. Pat. No. 4,586,730, Shulyak discloses a clipboard having thumb holes oriented along one side margin adapted for better holding of the clipboard during use.

A courier clipboard was invented by Mexicotte and disclosed in U.S. Pat. No. 4,610,324 which includes a scale within a hollow box, the cover acting as a clipboard when in a closed position.

Several clipboard design patents are also disclosed in prior art. One such design by Longhurst teaches an automobile desk with privacy screen in U.S. Des. 353,275, while, in U.S. Des. 324,399, a combined clipboard and stationery supply case invented by Murphy is there disclosed.

One of the co-inventors of the present case, K. Offenhauer, teaches a clipboard having a writing paper dispenser associated with the paper clip providing a high degree of convenience associated with such clipboard devices in U.S. Pat. No. 5,116,012.

In U.S. Pat. No. 5,145,141, Hunter teaches a clipboard adapted for multi-function use having a closely spaced pair of panel-like members for receiving printed information therebetween while also providing a writing surface in a conventional clipboard fashion.

Another unique clipboard adapted for multi-function use was invented by Hunter in U.S. Pat. No. 5,308,034. The clip portion of a clipboard configured as a housing with a lid is taught by Cornell in U.S. Pat. No. 5,413,382. In this device, the lid for the housing is selectively moveable to control access into the housing. Additional members are provided for removable attachment of a writing implement to the board itself.

An illuminated clipboard with a moveable writing surface is disclosed by Brotz in U.S. Pat. No. 5,607,223 which may be attached to the upper thigh of a user such as someone piloting a plane or driving an automobile.

In U.S. Pat. No. 6,386,589, Yuh teaches a clipboard having a clip mechanism including two spaced protuberances, a flexible plate and two U-shaped fastening members for fastening the body and the plate together for holding papers. A retractable hanging device and a board mechanism having four bottom channels for securing the clip mechanism to the board is also shown.

None of the above known prior art clipboard devices, however, appear to offer any degree of privacy with respect to previously recorded names and signatures, which privacy is required under HIPPA to be maintained as confidential information. This structure and functional feature of the present invention is clearly directed to that end and provides for the complete privacy associated with each patient or visitor sign-in on a multiple signature sign-in sheet attached to the clipboard itself.

BRIEF SUMMARY OF THE INVENTION

This invention is directed to a patient or visitor sign-in device having a privacy screen compliant with HIPPA privacy regulations. A generally rectangular clipboard supports a sign-in sheet for patent or visitor sign-in purposes and being held in place by a paper damp is pivotally connected at one end of said board. An elongated spool of substantially opaque flexible sheet material is held within a housing or support of the paper clamp, the spool extending transversely across the clipboard. Selective withdrawal of a portion of the opaque material from said spool to cover a portion of the sign-in sheet defines a privacy screen. An elongated header bar spaced parallel from the housing and extending transversely across is movably attached to a side margin of the board. The header bar is spaced sufficiently above the writing surface to allow the sign-in sheet to be slid therebetween. An exposed end margin of said opaque material is attached to the header bar whereby movement of said header bar along the length of said board causes the opaque material to be withdrawn from the spool forming the privacy screen which covers and conceals a selected portion of the sign-in sheet which includes the names and/or signatures of previously signed-in patients or visitors.

It is therefore an object of this invention to provide a clipboard with a sign-in sheet which is maintained in covered and concealed fashion so as to protect the privacy or identity of each previously signed-in patient or visitor.

Still another object of this invention is to provide a sign-in sheet clipboard which is HIPPA-compliant.

Yet another object of this invention is to provide a clipboard with a selectively covered sign-in sheet so that an attendant may easily insure that each new visitor or patient does not have visual access to patients or visitors who have previously signed in on the same sign-in sheet.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
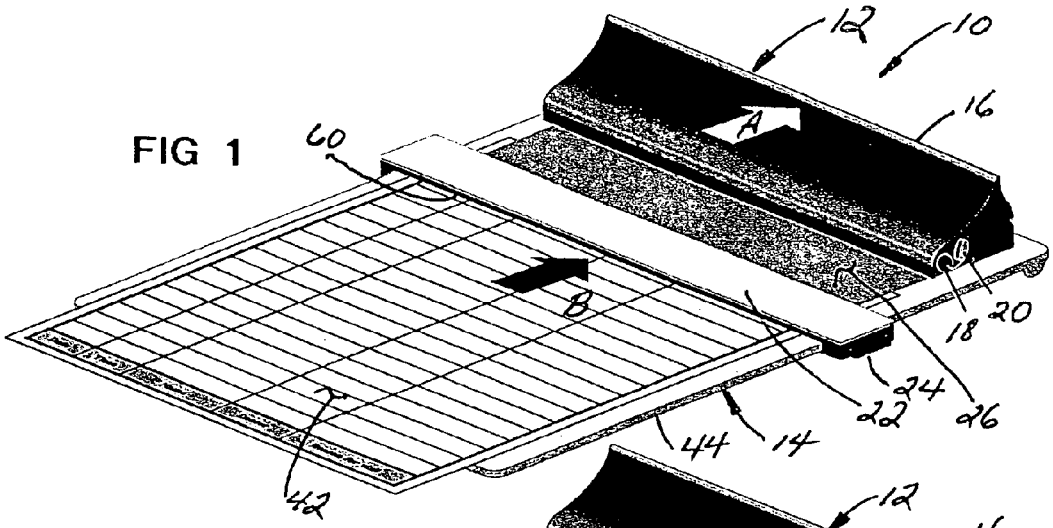
FIG. 1 is a perspective view of the invention showing the installation of a new sign-in sheet.
Figure 2:
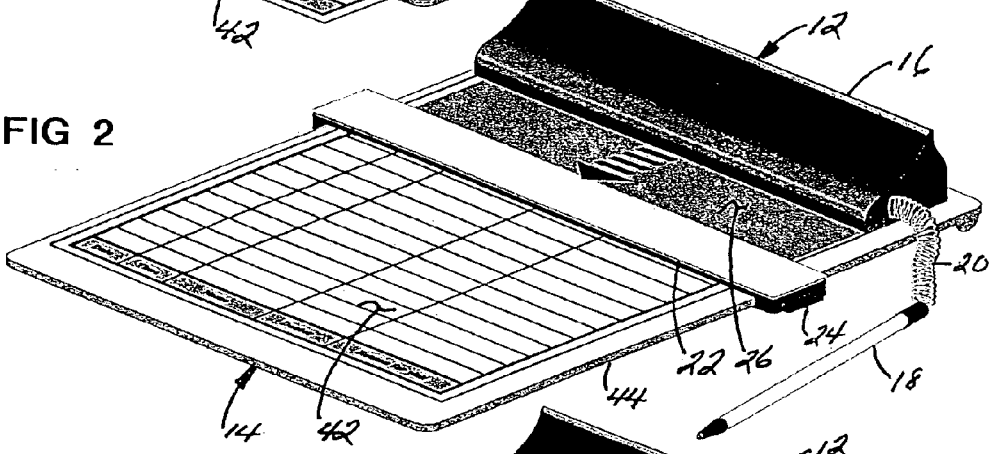
FIG. 2 is a perspective view of the invention showing the movement of a header bar and privacy sheet being moved to conceal and maintain the privacy of previously signed in visitors or patents.
Figure 3:
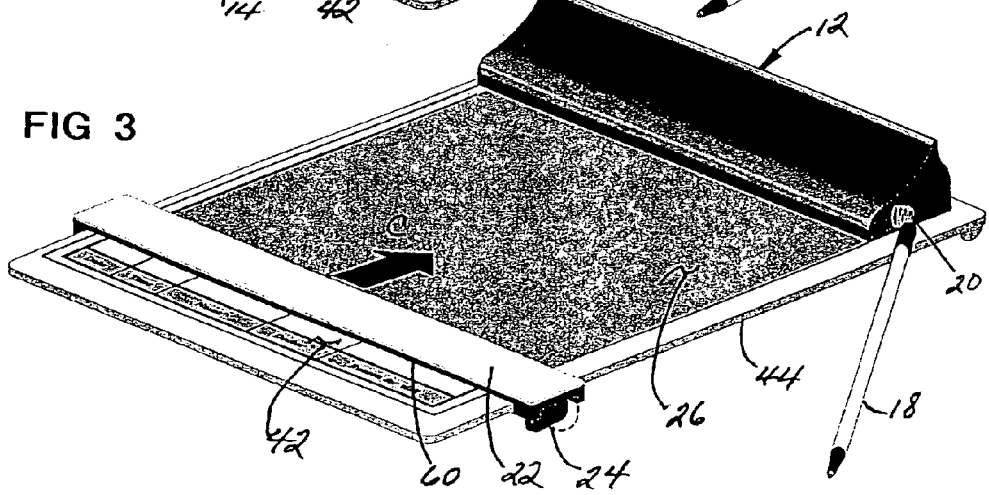
FIG. 3 is a perspective view of the invention showing the retraction of the privacy screen and header bar in preparation for sign-in sheet removal and replacement.

Referring now to the drawings and firstly to FIGS. 1 to 3, the invention is there shown generally at numeral 10 and includes a combination paper clamp and housing assembly 12 and clipboard 14. The combination paper clamp and housing assembly 12 is formed of molded plastic material and is elastically biased to retain a sign-in sheet 42 at the upper end thereof. By movement of the paper clamp housing 16 in the direction of arrow A by manual pressure there applied, the sign-in sheet 42, after being slid beneath a header bar 22 and attached privacy screen 26, is clampingly held for use as will be described in greater detail herebelow. The single use sign-in sheet 42 includes a plurality of rows and columns of line indicia printed thereon providing each patient or visitor signing in with space provided to enter a signature, printed name and other requested information.

An elongated header bar 22, described more fully herebelow, is slidably attached to the side margins of a rectangular board 44. As seen in FIG. 3, the locking member 24 is moved to the unlocked position whereupon the header bar 22 may be slidably moved in either direction of arrow C by an attendant while providing sufficient concealment of the locking members 24 so as to be unobviously releasable by a visitor or patient. When properly positioned along the length of the sign-in sheet 42, all previously signed in visitor signatures are covered and concealed, in part, by the header bar 22 itself and in larger part by a privacy screen 26 formed of flexible opaque material and described more fully herebelow.

The header bar 22 is spaced sufficiently from the writing surface of the rectangular board 44 by a gap 60 such that the sign-in sheet 42 is slidable in the direction of arrow B in FIG. 1 beneath the header bar 22 toward the paper clamp 16 for clamping engagement therebeneath.

Figure 6:
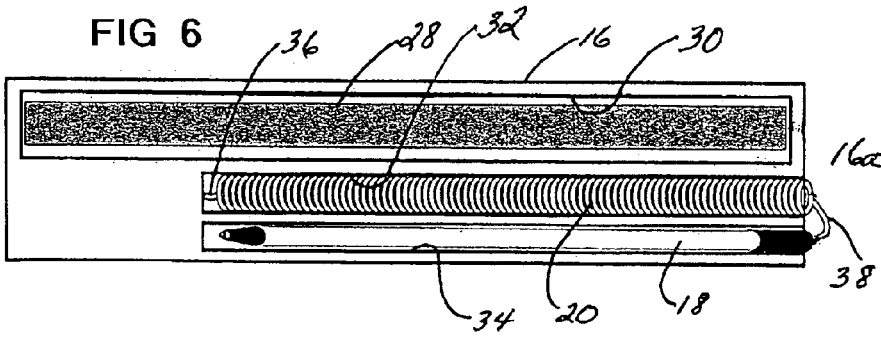
FIG. 6 is a top plan schematic view of the combination paper clamp and scroll housing of the invention.
Figure 7:
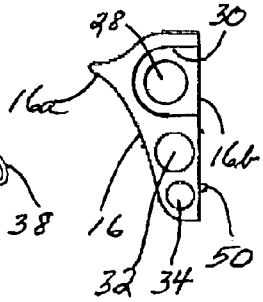
FIG. 7 is an end elevation view of FIG. 6.
Figure 8:
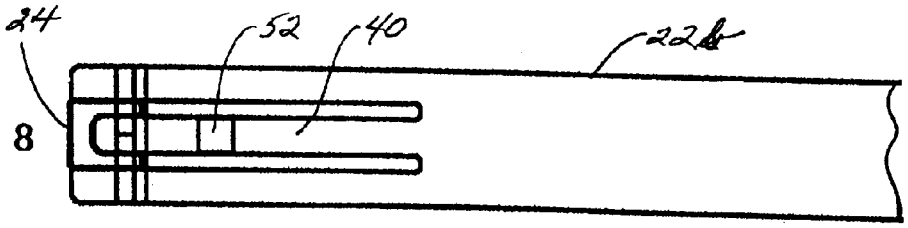
FIG. 8 is a bottom plan view of one end of the lower header bar of the invention.
Figure 9:
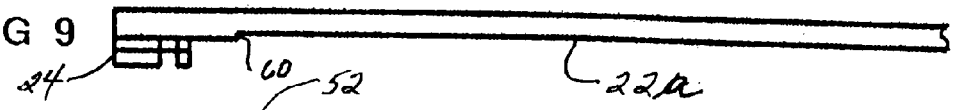
FIG. 9 is a side elevation view of the upper portion of the header bar of the invention.

As also seen in FIGS. 6 and 7, the housing 16 includes a plurality of spaced elongated cavities 30, 32 and 34. Cavity 34 is provided to storingly receive a writing instrument 18, while cavity 32 is provided to storingly receive a coiled retaining member attached to the non-writing end of the writing instrument 18 at 38 and is extendable as seen in FIGS. 2 and 3 for patient or visitor sign-in and then is retracted back into cavity 32 automatically by resiliency after which the writing instrument 18 may be placed back into its storage cavity 34.

Figure 4:
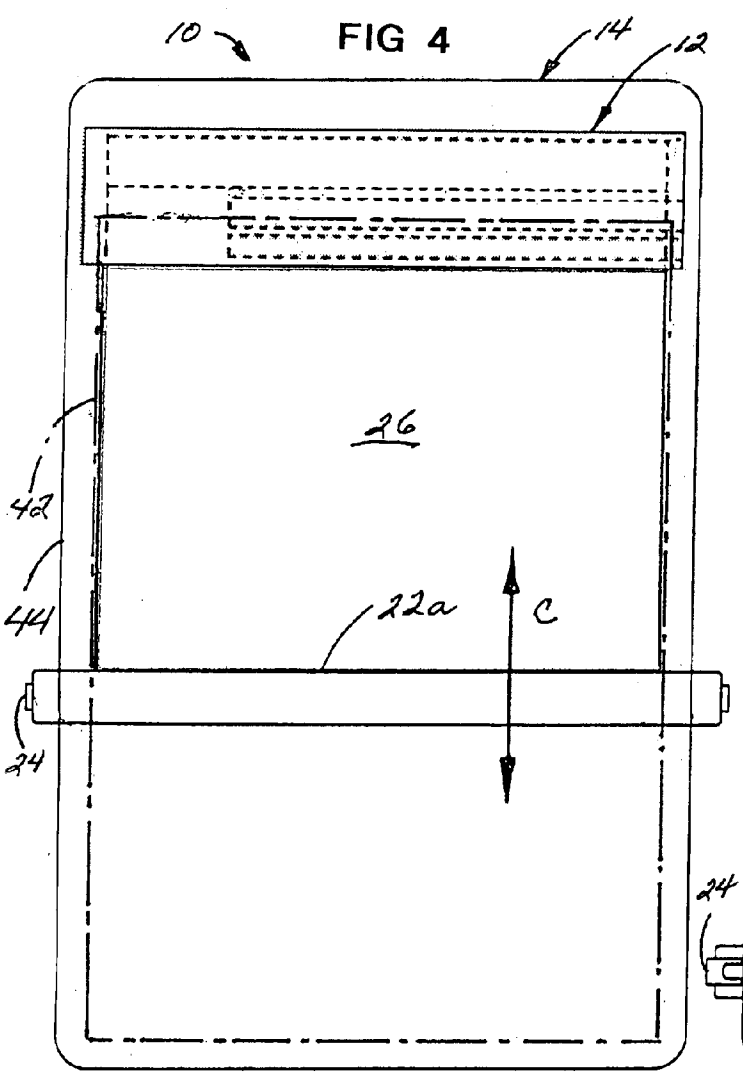
FIG. 4 is a top plan view of the invention.
Figure 14:
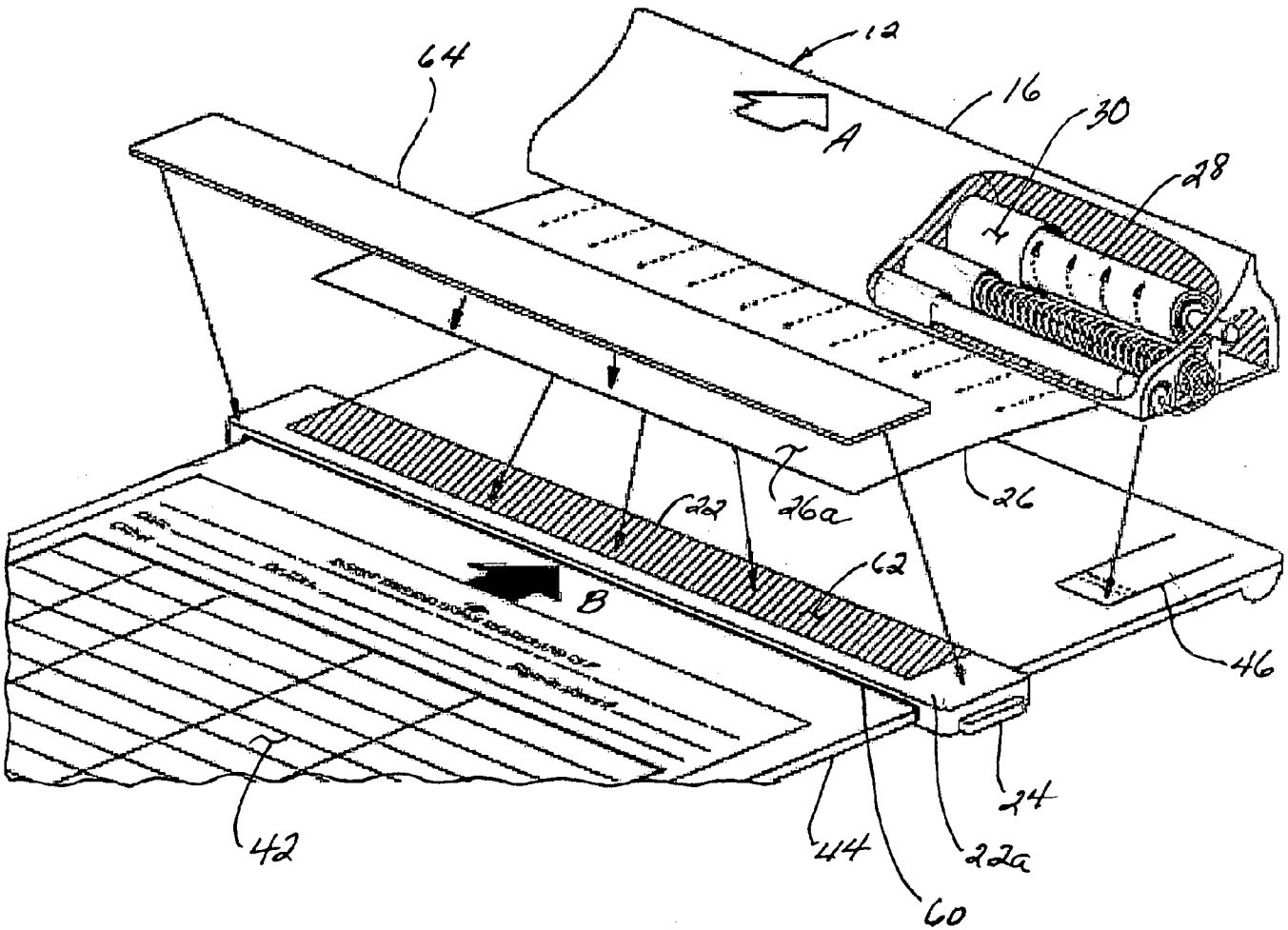
FIG. 14 is a perspective exploded, broken view of the invention showing details of the housing assembly and header bar.

The privacy screen 26 is provided in the form of a scroll 28 housed within cavity 30 for rotating movement only with the exposed end portion of the privacy screen 26 being attached to the header bar 22 as seen in FIG. 14. Thus, by moving the header bar 22 in the direction of arrow C shown in FIGS. 3 and 4, the privacy screen 26, formed of flexible opaque material such as paper or thin plastic-like material, is selectively extended from the scroll 28 so as to cover all previous signatures and patient or visitor information which has previously been recorded onto the sign-in sheet 42 in each successive descending horizontal space provided on the printed sign-in sheet 42.

Figure 5:
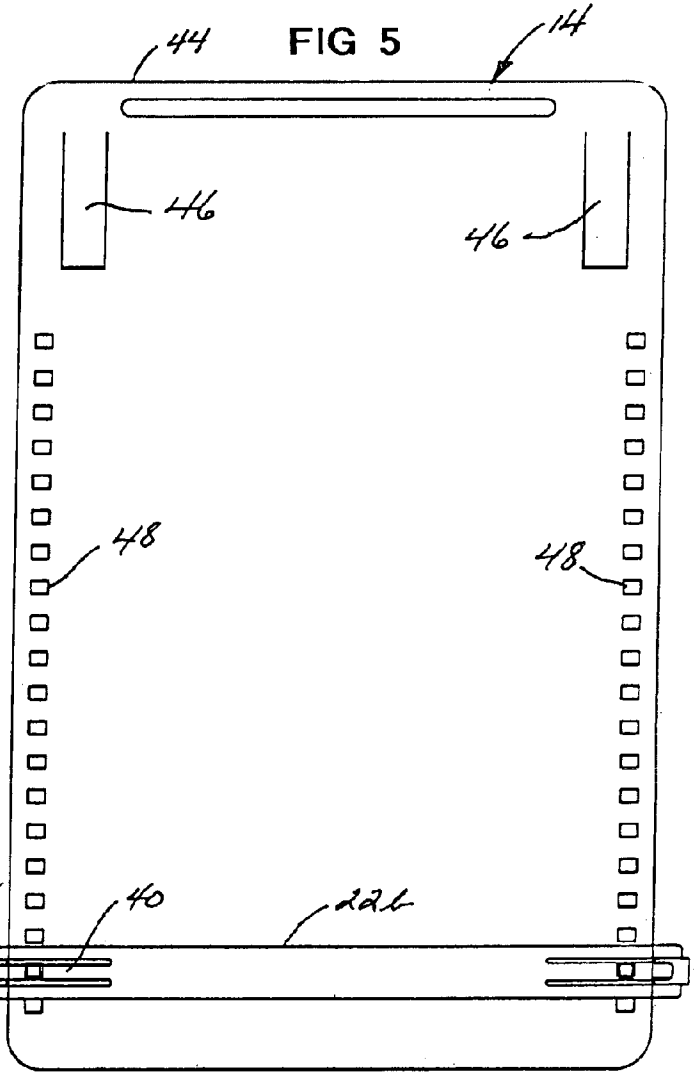
FIG. 5 is a bottom plan view of the invention.
Figure 15:
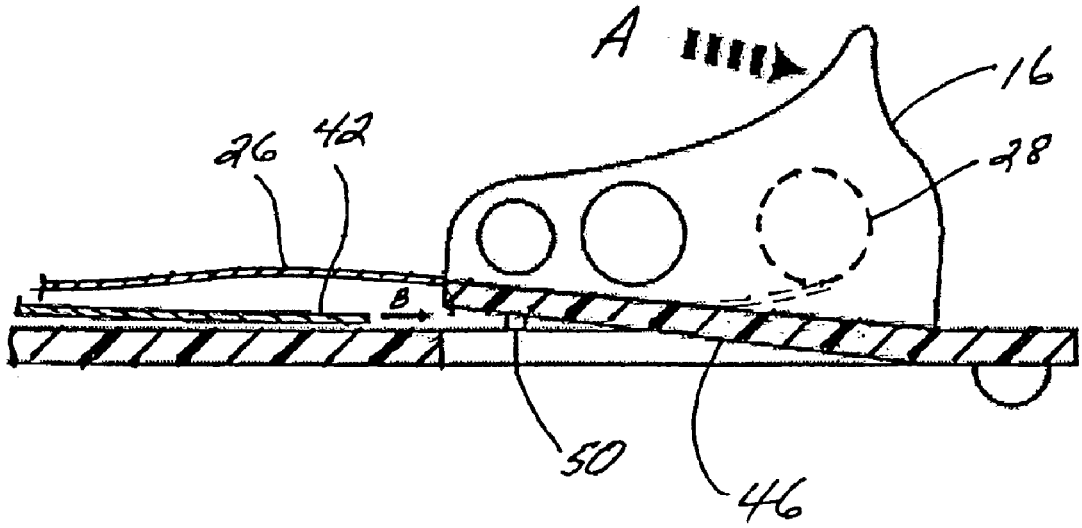
FIG. 15 is an enlarged partial side elevation section view of a portion of the clipboard and housing attached to the clipboard and showing the resilient clamping action of the paper clamp.

The paper clamp assembly 12 is attached to tabs 46 which are formed by cutting through the clipboard itself in an elongated U-shaped fashion as shown in FIGS. 5, 14 and 15. Each of these tabs 46 is thus made resilient when mechanically attached by threaded fasteners into the bottom of the housing 16. Note that both the sign-in sheet 42, as well as the privacy screen 26, receive clamping retaining pressure exerted by the resiliency of tabs 46 urging the housing 16 and the locking bead 50 thereagainst.

As seen in FIGS. 5 and 8 to 13, the header bar 22 is formed of an upper header bar portion 22*a* and a lower header bar portion 22*b* which are interconnected together as by appropriate plastic adhesive at the mating ends thereof. The upper header bar portion 22*a* includes the sign-in sheet gap 60 as previously described for clearance and easy replacement of each sign-in sheet 42 after being filled with signatures.

Figure 11:
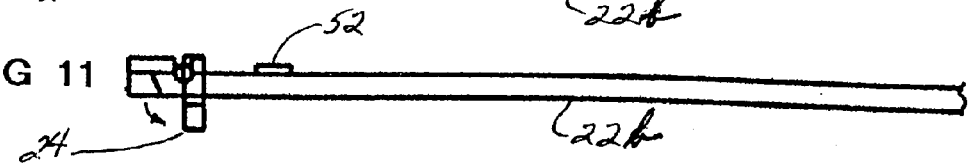
FIG. 11 is a side elevation view similar to FIG. 9 in the unlocked position.
Figure 13:
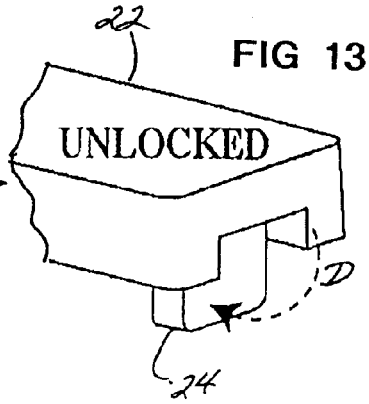
FIG. 13 is a simplified view similar to FIG. 12 in the unlocked position.

The lower header bar portion 22*b* includes the locking member 24 at each end thereof which is pivotally held about a transverse axis for movement in the direction of the arrow shown in FIGS. 11 and 13. Also upwardly disposed adjacent each end of the lower header bar portion 22*b* is a locking lug 52 which is sized for locking engagement into one of a pair of similarly sized locking apertures 48 which extend along and adjacent to each side margin of the board 44 as seen in FIG. 5. The locking lug 52 is formed onto a resilient elongated tab 40 such that, when the locking member 24 is rotated into the position shown in 11 and 13, tab 40 is resiliently downwardly flexed to effect disengagement of each lug 52 from the corresponding locking apertures 48, whereupon the header bar 22 may be slidably moved in the direction of arrow C so as to cause the privacy screen 26 to appropriately cover previous signatures and names having been entered onto the sign-in sheet 42 in descending order as above described.

Figure 10:
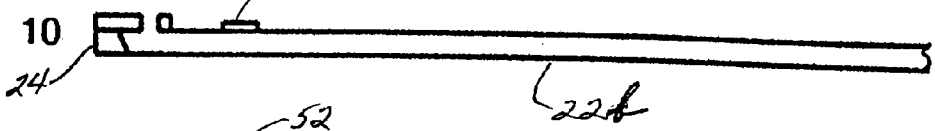
FIG. 10 is a side elevation view of FIG. 8.
Figure 12:
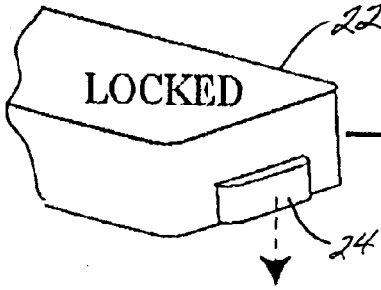
FIG. 12 is an enlarged simplified perspective view of one end of the header bar in the locked position.

Moving the locking member 24 back into the locked position shown in FIGS. 10, 11 and 12, combined with slight movement of the header bar 22 in the direction of arrow C for adjustment, causes each locking lug 52 to biasingly engage into an aligned locking aperture 48.

Figure 16:
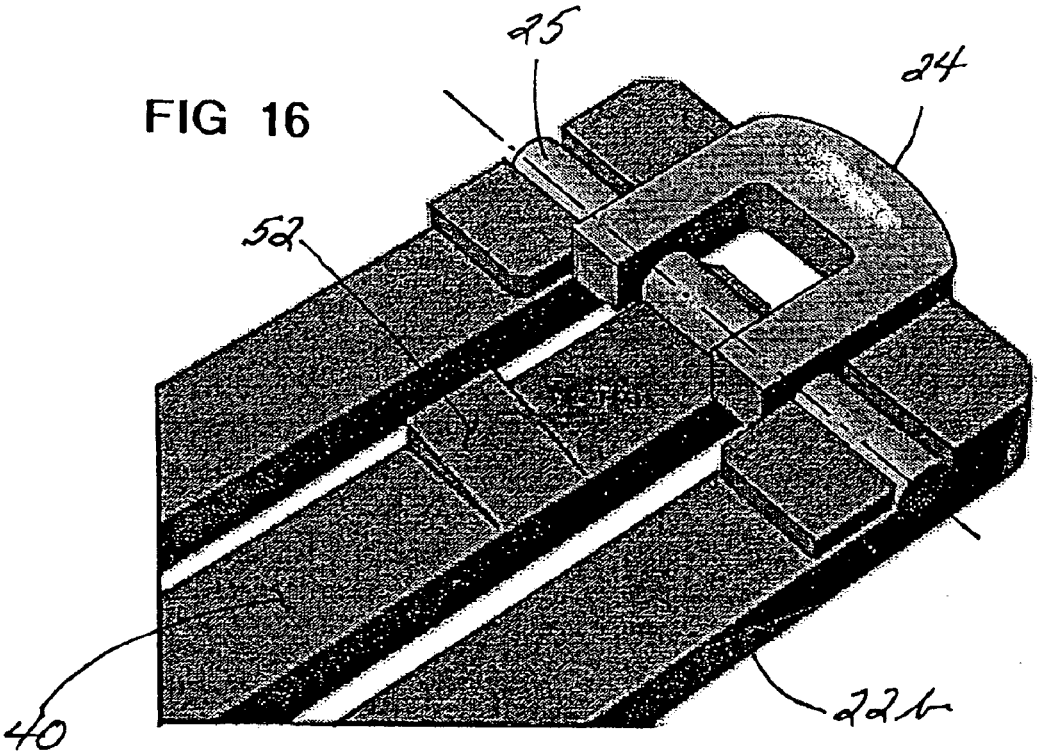
FIGS. 16 and 17 are perspective views of one end of the lower header bar as seen in FIGS. 8 to 11.
Figure 17:
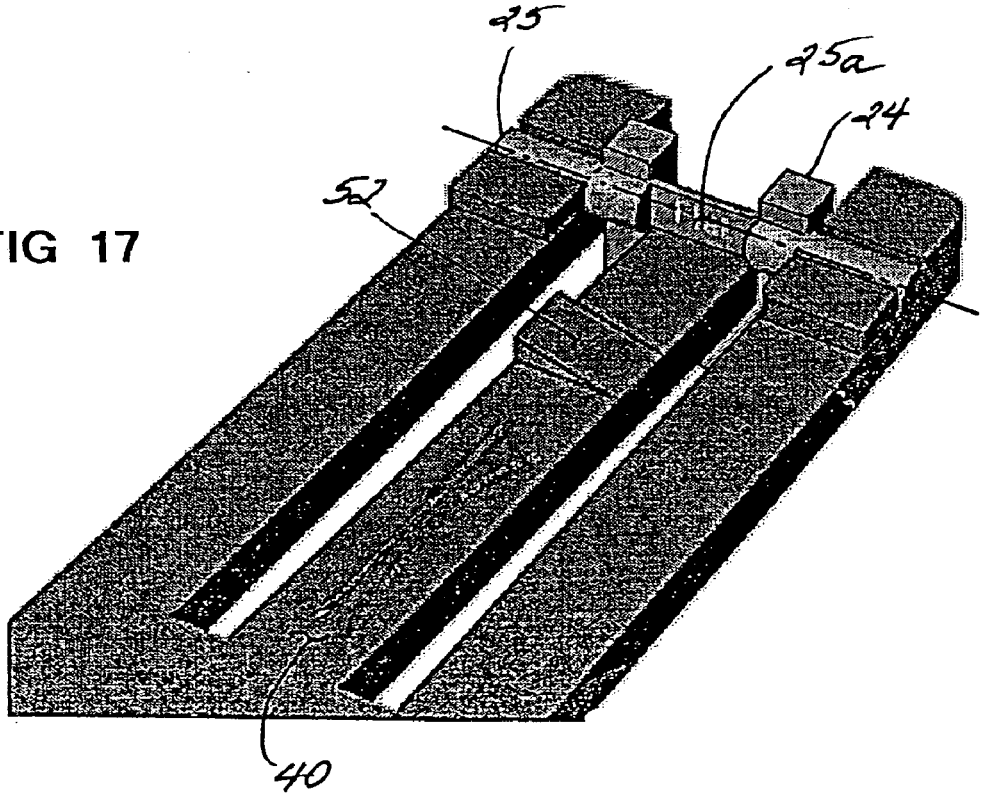

Note in FIGS. 16 and 17 that, when the locking member 24 is pivoted from the locked position shown in FIG. 16 to the unlocked position shown in FIG. 17, the locking lug 52 is fully disengaged from the corresponding locking aperture 48 as previously described. This pivotal action is facilitated by support provided by the mounting shafts 25 integrally molded with the locking member 24.

In the locked position of FIG. 16, the flat 25*a* is aligned against the distal end of tab 40 which allows the locking lug 52 to be engaged into the corresponding locking aperture 48. When the header bar 22 is in the locked position, the wedge shape of each of the locking lugs 52 allows the header bar 22 to advance only downwardly to cover the next successive signature without releasing the locking member 24. However, to return the header bar 22 upwardly toward the housing 16, the locking member 24 must be pivoted to the unlocked position as previously described.

Referring particularly to FIG. 14, the header bar 22 is provided with an adhesive area 62 which is applied to the upper surface of the upper header bar portion 22*a*. The exposed end portion 26*a* of the privacy screen 26 is attached atop the adhesive strip 62 in the direction of the arrows. Thereafter, a crystal cap 64 is provided which is also adhesively attached atop the upper header bar portion 22*a* and sandwiching the end portion 26*a* of the privacy screen 26 therebetween. The crystal cap 64 may include artwork and/or sign-in information and/or other suitable indicia as desired.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A patient or visitor sign-in device with privacy screen comprising:

a generally rectangular flat board defining a writing surface sized to supportively receive a sign-in sheet bearing sequential line indicia printed thereon providing each patent or visitor with a separate line for sign-in purposes;

a paper clamp pivotally connected at one end of said board for clamping the sign-in sheet against the writing surface;

an elongated spool of substantially opaque flexible sheet material;

said paper clamp including a housing extending transversely across said board for storing therewithin and selectively withdrawing therefrom a portion of said opaque material from said spool to define the privacy screen;

an elongated header bar spaced from said housing and extending transversely across, and movably attached to a side margin of, said board;

said header bar being spaced sufficiently from said writing surface to allow the sign-in sheet to be slid therebetween;

an exposed end margin of said opaque material being attached to said header bar whereby movement of said header bar along the length of said board causes said opaque material to be withdrawn from said spool to cover and conceal a selected portion of the sign-in sheet which includes the names and/or signatures of previously signed-in patients or visitors.

2. A patient or visitor sign-in device as set forth in claim 1, wherein:

said housing also holds a writing instrument in spaced parallel relation to said spool and a means for attaching the writing instrument to said housing to prevent removal of said writing instrument.

3. A patient or visitor sign-in device as set forth in claim 1, wherein:

said header is lockably engageable with the side margin of said board to prevent inadvertent or unauthorized viewing of previous names and/or signatories on said sign-in sheet.

4. A patient or visitor sign-in device as set forth in claim 3, wherein:

said opaque sheet is self-retracting onto said spool as said header bar is moved closer to said housing.

5. A sign-in clipboard comprising:

a generally rectangular flat board defining a writing surface sized to supportively receive a sign-in sheet bearing sequential line indicia printed thereon providing each successive visitor with a separate line for sign-in purposes positioned immediately below the names and/or signatures of the previous visitors;

a paper clamp pivotally connected at one end of said board for clamping said sign-in sheet against the writing surface;

an elongated spool of substantially opaque flexible sheet material;

said paper clamp including a housing extending transversely across said board for storing therewithin, and for selectively withdrawing a portion of said opaque material from said spool;

an elongated header bar spaced from said housing and extending transversely across, and movably attached to and guided by a side margin of, said board;

said header bar being spaced sufficiently from said writing surface to allow said sign-in sheet to be slid therebetween for engagement by said paper damp;

an exposed end margin of said opaque material being attached to said header bar whereby movement of said header bar along the length of said board causes said opaque material to be withdrawn from said spool to cover and conceal a selected portion of the sign-in sheet which includes the names and/or signatures of all previously signed-in visitors.

6. A patient or visitor sign-in device as set forth in claim 5, wherein:

said housing also holds a writing instrument in spaced parallel relation to said spool and a means for attaching the writing instrument to said housing to prevent removal of said writing instrument.

7. A patient or visitor sign-in device as set forth in claim 5, wherein:

said header is lockably engageable with the side margin of said board to prevent inadvertent or unauthorized viewing of previous names and/or signatories on said sign-in sheet.

8. A patient or visitor sign-in device as set forth in claim 7, wherein:

said opaque sheet is self-retracting onto said spool as said header bar is moved closer to said housing.

9. A patient or visitor sign-in device having a HIPPA-compliant privacy screen comprising:

a sign-in sheet bearing printed spaced horizontal lines thereon providing each patent or visitor with a separate line for sign-in purposes;

a generally flat clipboard defining a writing surface sized to supportively receive said sign-in sheet thereatop;

a paper clamp pivotally connected at one end of said board for clamping one end of said sign-in sheet against said writing surface;

an elongated spool of substantially opaque flexible sheet material forming a privacy screen;

said paper clamp including a support for said spool extending transversely across said board for selective withdrawal of a portion of said opaque material from said spool;

an elongated header bar spaced from said spool and extending transversely across, and movably attached to a side margin of, said board;

said header bar being spaced sufficiently above said writing surface to allow the sign-in sheet to be slid therebetween;

an exposed end margin of said opaque material being attached to said header bar whereby movement of said header bar along the length of said board causes said opaque material to be withdrawn from and automatically rewound onto said spool to provide said privacy screen covering and concealing the names and/or signatures of previously signed-in patients or visitors.

10. A patient or visitor sign-in device as set forth in claim 9, wherein:

said header is lockably engageable with the side margin of said board to prevent inadvertent or unauthorized viewing of previous names and/or signatories on said sign-in sheet.

11. A patient or visitor sign-in device as set forth in claim 9, wherein:

said opaque sheet is self-retracting onto said spool as said header bar is moved closer to said housing.

* * * * *